US009982477B1

(12) United States Patent
Glickman et al.

(10) Patent No.: US 9,982,477 B1
(45) Date of Patent: May 29, 2018

(54) EXPANDABLE, ONE-PIECE SILL PAN FLASHING

(71) Applicants: Joel I. Glickman, Jupiter, FL (US); Kieran McMahon, Ambler, PA (US)

(72) Inventors: Joel I. Glickman, Jupiter, FL (US); Kieran McMahon, Ambler, PA (US)

(73) Assignee: Sill Dry Industries, LLC, Hatfield, PA (US)

( * ) Notice: Subject to any disclaimer, the term of this patent is extended or adjusted under 35 U.S.C. 154(b) by 0 days. days.

(21) Appl. No.: 15/496,654

(22) Filed: Apr. 25, 2017

(51) Int. Cl.

| | |
|---|---|
| ***E06B 1/62*** | (2006.01) |
| ***E06B 3/96*** | (2006.01) |
| ***E06B 1/70*** | (2006.01) |
| ***E06B 3/30*** | (2006.01) |
| ***E06B 7/14*** | (2006.01) |
| ***E06B 7/22*** | (2006.01) |

(52) U.S. Cl.
CPC ..... *E06B 1/62* (2013.01); *E06B 1/702* (2013.01); *E06B 3/308* (2013.01); *E06B 3/9632* (2013.01); *E06B 7/14* (2013.01); *E06B 7/22* (2013.01); *E06B 2001/628* (2013.01)

(58) Field of Classification Search
CPC . E06B 3/9632; E06B 7/22; E06B 7/14; E06B 1/702; E06B 1/705; E06B 3/308; E06B 2001/628; E06B 1/62; E06B 1/70; E06B 1/665; E06B 7/26
See application file for complete search history.

(56) References Cited

U.S. PATENT DOCUMENTS

| | | | | |
|---|---|---|---|---|
| 1,677,130 | A | 7/1928 | Cherry | |
| 5,072,552 | A * | 12/1991 | Sauder | E04D 13/1407 52/219 |
| 5,581,959 | A * | 12/1996 | Occhipinti | B29C 53/043 52/198 |
| 6,122,874 | A | 9/2000 | Smerilli | |
| 6,681,530 | B1 | 1/2004 | Givens | |
| 7,222,462 | B2 | 5/2007 | Ellingson | |
| 7,351,296 | B2 | 4/2008 | Waggoner et al. | |
| 7,673,426 | B2 | 3/2010 | Broad et al. | |
| 7,877,945 | B2 * | 2/2011 | Eggen | E06B 1/62 52/209 |
| 8,443,554 | B1 | 5/2013 | Teodorovich | |

(Continued)

*Primary Examiner* — Adriana Figueroa
*Assistant Examiner* — Jessie Fonseca
(74) *Attorney, Agent, or Firm* — St. Onge Steward Johnston & Reens, LLC

(57) ABSTRACT

A sill pan flashing is provided with a width-extendable accordion section enabling the flashing to be manufactured, shipped and installed in one piece regardless of significant variations in the actual width of a framing sill from a designed nominal width. The flashing includes opposite side end caps connected by a horizontal sill cover. The sill cover includes one or more accordion sections configured with a plurality of integrally formed accordion elements which may be of V-shape, U-shape, sinusoidal or other configuration, allowing the one-piece flashing to be elongated in the width direction during installation, in order to completely cover a sill member. The new flashing is manufactured in one piece for a minimum sill width and expanded as necessary during installation at the job site to fully cover the entire surface of a sill of greater width. Substantial savings can be realized while providing a superior moisture seal.

13 Claims, 12 Drawing Sheets

(56) References Cited

U.S. PATENT DOCUMENTS

| | | | | |
|---|---|---|---|---|
| 2005/0217189 | A1* | 10/2005 | Moffitt | E06L 37/14 52/209 |
| 2008/0229676 | A1* | 9/2008 | Allen | E06B 1/62 52/58 |
| 2009/0056241 | A1* | 3/2009 | Koessler | E06B 1/62 52/97 |
| 2009/0272045 | A1* | 11/2009 | Teodorovich | E06L 31/702 52/58 |

* cited by examiner

EXPANDABLE, ONE-PIECE SILL PAN FLASHING

FIELD OF THE INVENTION

The invention relates generally to the field of home and office construction and more particularly to a novel and improved sill pan flashing for installation at the bottom of the rough framing of a window opening in order to prevent penetration of water underneath a window unit and into the underlying framing structure.

BACKGROUND OF THE INVENTION

In the home construction industry, it is typical for windows to be constructed as independent, prefabricated units and installed in framed openings constructed in the exterior walls of the home. The exterior framing of the window units overlap the exterior of the housing wall around the framed openings and initially are sealed to prevent access of moisture. Over time the sealing material may deteriorate and allow some moisture to penetrate. This can result in deterioration of the wood framing and of housing structure below the framed opening. Accordingly, in many such structures it is the practice to install a sill pan flashing between the bottom of the prefabricated window unit and the underlying sill plate of the framing. The sill pan flashing is formed of a suitable plastic or metal material and serves to direct any collected water outward to the exterior of the siding. Examples of such sill pan flashing devices are shown in U.S. Pat. No. 1,677,130, U.S. Pat. No. 7,222,462, U.S. Pat. No. 7,673,426, and U.S. Pat. No. 8,443,554. A typical framed window opening includes a horizontal sill plate and spaced apart vertical elements, joined to opposite ends of the sill plate and extending upward therefrom. The upper ends of the vertical elements are joined to a header member, which extends horizontally between the vertical members and forms a closed opening, usually of rectangular configuration, in which a prefabricated window unit can be received. The elements comprising the framed opening typically may be formed of 2"×4" lumber. In addition, a rough siding typically is secured to the exterior framing of the structure, and an opening is cut into the rough siding in the size and shape to coincide with the framed opening. The rough siding may be of ½" or ¾" plywood, for example.

A sill pan flashing of typical construction includes a sill cover arranged to extend over the full width of the sill plate, which forms the bottom member of the framed opening. The sill cover is tilted forwardly to allow to allow water to drain forwardly toward the exterior of the structure. Typically, a front flange extends downward a short distance from the front of the sill cover to guide the flow downward over the exterior shingles, siding or other outer surface of the finished structure. The front flange typically extends laterally a few inches beyond the sides of the opening so as to cover a small front area of the rough siding. Portions of the front flange also extend upwardly a few inches above the level of the sill plate at each side of the opening. Side flanges also extend upward a few inches from each end of the sill cover and overlie lower portions of the vertical framing members. The side flanges are joined at their front vertical edges with the upwardly extending portions of the front flange to form rigid corners structure at opposite sides of the framed opening.

It is standard construction practice to dimension the rough-framed window openings to dimensions somewhat larger than the standard dimensions of the prefabricated windows to be inserted therein. Window manufacturers recommend that the opening defined by the framing be a half to three-quarters inch larger than the nominal size of the window. In actual practice it is common for the dimensions of the rough framing to vary significantly from the recommended tolerances, anywhere from a half to three-quarters inch smaller to more than an inch larger than recommended. This presents a problem with respect to the installation of the sill pan flashings, because the required width of the flashing, in order to fit snuggly between the vertical elements of the frame, may be different for each of many framed openings that are "nominally" of the same size. Heretofore, this commonly has been dealt with by forming the sill pan flashings in two or three (sometimes more) pieces, which are assembled in the field to fit the individual openings. A two-piece assembly, for example, is made to fit the largest opening expected to be encountered in the field for a given nominal size window unit. For a prefabricated window unit of 24" nominal width for example, the specified framing opening may be 24.5"-24.75". However, the actual opening made by the carpenters at the job site might range from as large as 25.5" or greater to as small as 24.0". Thus, a conventional two-piece sill pan flashing, intended for a window unit of nominal 24" width, is dimensioned so that the pieces have a total width substantially greater than the anticipated maximum opening of 25.5", enabling the two pieces to be assembled in the field in partially overlapping relation to fit a range of opening sizes. Typically, a sealant is applied in the field where the two pieces overlap, to avoid leakage at the interface between the parts.

The above described procedures, while enabling the flashing to be fit suitably to the framed opening, have important disadvantages. Among others, the individual installation of the two (or more) components, and the sealing of the interface(s) between them consumes extra labor time and thus adds to the cost of construction. Additionally, construction sites are often somewhat chaotic, and it is not uncommon for the individual components of a multi-part flashing assembly to become separated at the job site, so that all of the mating parts may not be readily available when the worker is ready to install them. Also, where application of a sealant is required, as it always is the sill pan has more than one piece, a worker may not have a caulking gun readily at hand when needed and may have to interrupt the assembly to find and fetch it.

It has been proposed heretofore to fabricate a sill pan flashing in one piece, sized suitably at a width greater than the maximum expected width of the rough opening. Although the proposed one-piece flashing can be shipped to the job site as a single unit, it must be cut into two parts at the job site in order to fit the opening. The then two-piece assembly is overlapped and sealed during installation in the same manner as the above-described multi-piece assemblies, with the addition of the cutting operation and the requirement of the necessary tools to perform the cutting operation. Such a proposal is found in the Broad et al. U.S. Pat. No. 7,673,426.

There thus remains a long-felt need for an improved form of sill pan flashing that can be fabricated, shipped and installed in one piece with attendant reduction in labor costs and inventory issues, and with improved performance.

SUMMARY OF THE INVENTION

Pursuant to the invention, a novel and improved form of sill pan flashing is provided, which is fabricated in one piece, delivered to the job site in one piece, and installed in the window framing in one piece, with resultant savings from various sources, but with particular benefits in labor costs at the job site as well as improved performance derived from the absence of need to seal an interface between individual parts. The device of the invention comprises end cap structures at each side arranged to be seated against lower portions of the vertical elements of the framing, and a central portion joined with the end cap structures and forming therewith a continuous sill cover. Pursuant to the invention the central portion of the sill pan flashing includes one or more accordion sections configured to allow for a predetermined amount of width expansion of the flashing. The designed width of the new flashing corresponds to or is slightly less than the minimum width of a framed opening that can receive a prefabricated window unit of a given nominal width. However, the one or more accordion sections integrally incorporated into the central portion of the flashing accommodate sufficient width expansion of the flashing to enable it to be extended to the full width of the framed opening during installation, regardless of the wide variations in such width typically encountered at the job site. In a typical installation procedure according to the invention, one of the end caps is secured tightly against an adjacent vertical member of the frame, for example by nailing or stapling. Then the second end cap is urged laterally, expanding the accordion section or sections until the second end cap engages the opposite vertical member of the rough framing. The second end cap is then fastened in place against the opposite vertical member.

In one advantageous embodiment of the invention, the end caps are formed by injection molding of a rigid plastic material. The central portion can be formed with a material such as flexible vinyl, as by thermoforming. The opposite end edges of the central portion are configured to join with the inside end edges of the end caps enabling the end caps and central portion to be permanently bonded as one piece at the factory. Between its opposite end edges the central portion is formed as an accordion section, with a series of suitably shaped grooves (e.g., V-shaped, U-shaped, sinusoidal, etc.) to allow the central portion to be extended in the width direction as necessary to accommodate a full range of frame openings that would be encountered in the field.

For a more complete understanding of the above and other features and advantageous of the invention, reference should be made to the following detailed description of a preferred embodiment thereof and to the accompanying drawings.

DETAILED DESCRIPTION OF THE INVENTION

Figure 1:
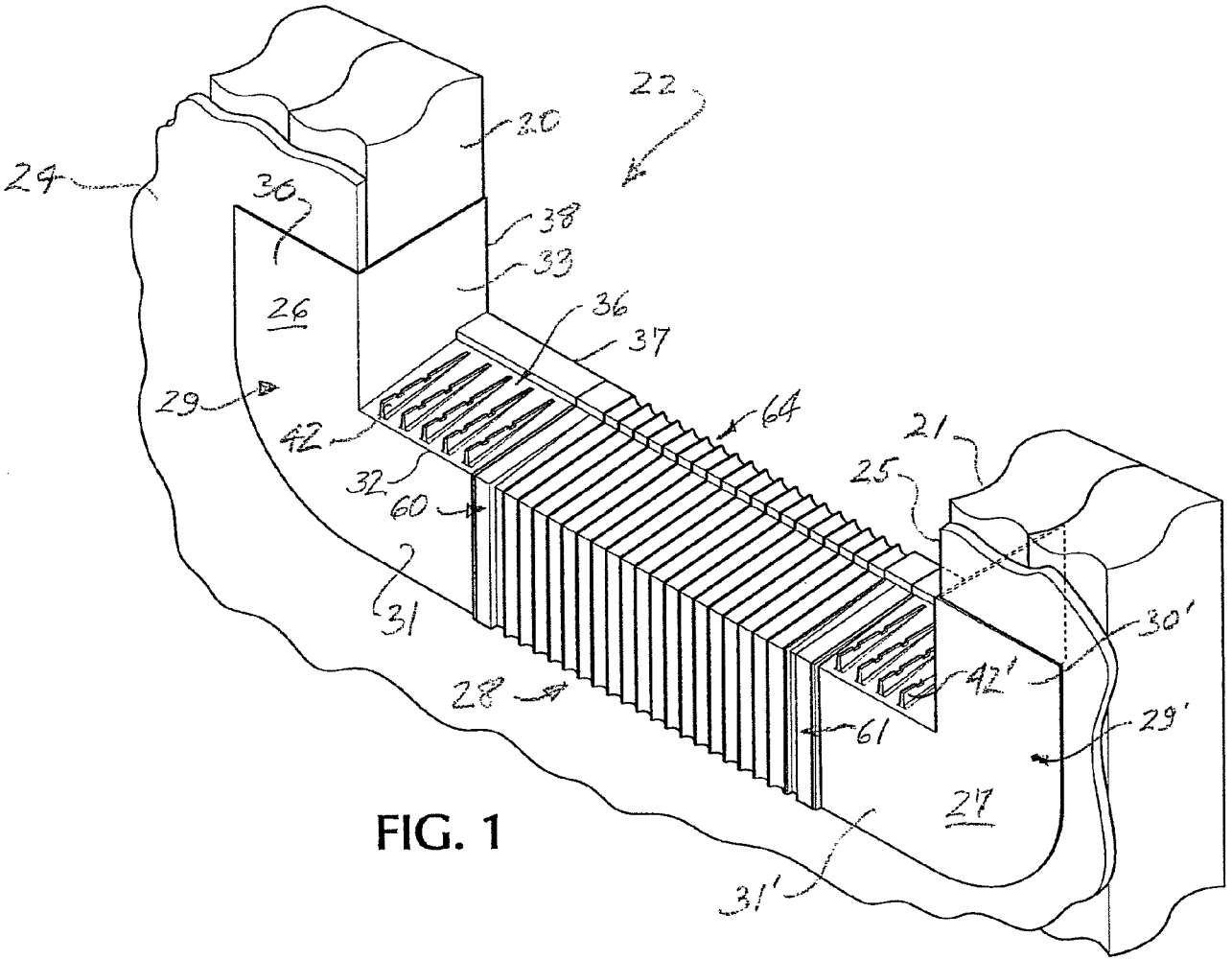
FIG. 1 is an orthographic view of a portion of a rough-framed window opening with a preferred embodiment of a one-piece sill pan flashing according to the invention mounted therein.

Referring to the drawings, and initially to FIG. 1 thereof, the reference numerals 20, 21 designate vertical framing members, frequently 2"×4" lumber, which form opposite sides of a rough-framed window opening 22 as provided in a typical home under construction. A horizontal framing sill 23, visible in FIG. 8, extends between the vertical framing members 20, 21 and forms the bottom of the framed opening 22. An upper horizontal member (not shown) extends between upper portions of the vertical framing members 20, 21 and forms the top of the framed opening 22. An outer sheathing 24, typically of plywood, is applied to the outer framing, and an opening 25 is formed in the sheathing to correspond with the framed opening 22.

Prefabricated window units (not shown) typically are manufactured to standardized dimensions, to be received in framed openings, which are themselves designed to standardized dimensions. Typically, for a normal sized window, the framing is intended to be about ½ to ¾ inch larger than the dimensions of the prefabricated window unit intended to be received in the opening. The prefabricated window typically is provided with an external flange surrounding the body of the window. The external flange, when the window is inserted into the framed opening 22, extends beyond the edges of the opening 22 and overlies the front face of the sheathing 24. Typically, a protective layer of Tyvek® or the like (not shown) is applied over the sheathing 24 for improved weatherproofing.

Although the prefabricated window units typically are manufactured accurately to relatively close tolerances, the same cannot be said for the construction of the framed window openings. The window openings are considered rough framing and acceptable tolerances may be up to ½ to ¾" inch smaller than a nominal rough frame width and considerably greater (perhaps an inch or inch and one half wider than the nominal width of a frame intended to receive a typical double-hung window unit, and potentially even more for wider windows, such as picture windows). Thus, for a window of nominal 24 inch width, the nominal rough frame width to accommodate the window would be 24.5", and the actual frame width encountered in the field likely would range from 24", as a minimum, to 25.5" or more as a maximum.

Pursuant to the invention, a one-piece sill pan flashing is provided which has sufficient expandability in the width direction to accommodate a full range of width variations in the rough framing without requiring cutting and fitting on the job site. The designed, at-rest width of the one-piece flashing is no greater than, and preferably slightly less than, a width "W" of the intended prefabricated window unit. Thus the flashing does not have to be compressed in the width dimension when being installed in a rough framed opening of minimum width to receive the window unit. At the same time, the one-piece flashing is sufficiently expandable to enable the width to be extended to the maxim frame width that would be acceptable for receiving the prefabricated window unit.

With reference initially to FIGS. 1-11, the sill pan flashing of the invention includes left and right end caps 26, 27 joined by a connecting section 28. The two end caps are of the same construction, but of opposite hand, and the description of the left end cap 26 will for the most part apply to the right end cap 27, with corresponding primed reference numerals being frequently used with respect to the right end cap. Referring in particular to FIGS. 7-11, the left end cap 26 preferably is an injection molding of a relatively rigid material, such as rigid polyvinyl chloride (pvc) and comprises a front flange 29 of generally L-shaped configuration arranged to be seated against the front face of the sheathing 24. An upper portion 30 of the front flange extends above the level of the framing sill 23 and a lower portion 31 of the front flange extends laterally inward a predetermined distance, with its upper edge substantially level with the top of the sill 23. A side flange 33 is disposed at right angles to the front flange 29, and the forward vertical edge 34 of the side flange 33 is joined integrally with an inside vertical edge 35 of the upper front flange portion 30 to form a rigid, right angle configuration. The side flange 33 is arranged to be seated against the vertical framing member 20, with the front flange 29 seated against the sheathing 24, as shown in FIG. 1. The bottom edge 33*a* of the side flange extends downward to rest upon the sill 23.

Figure 2:
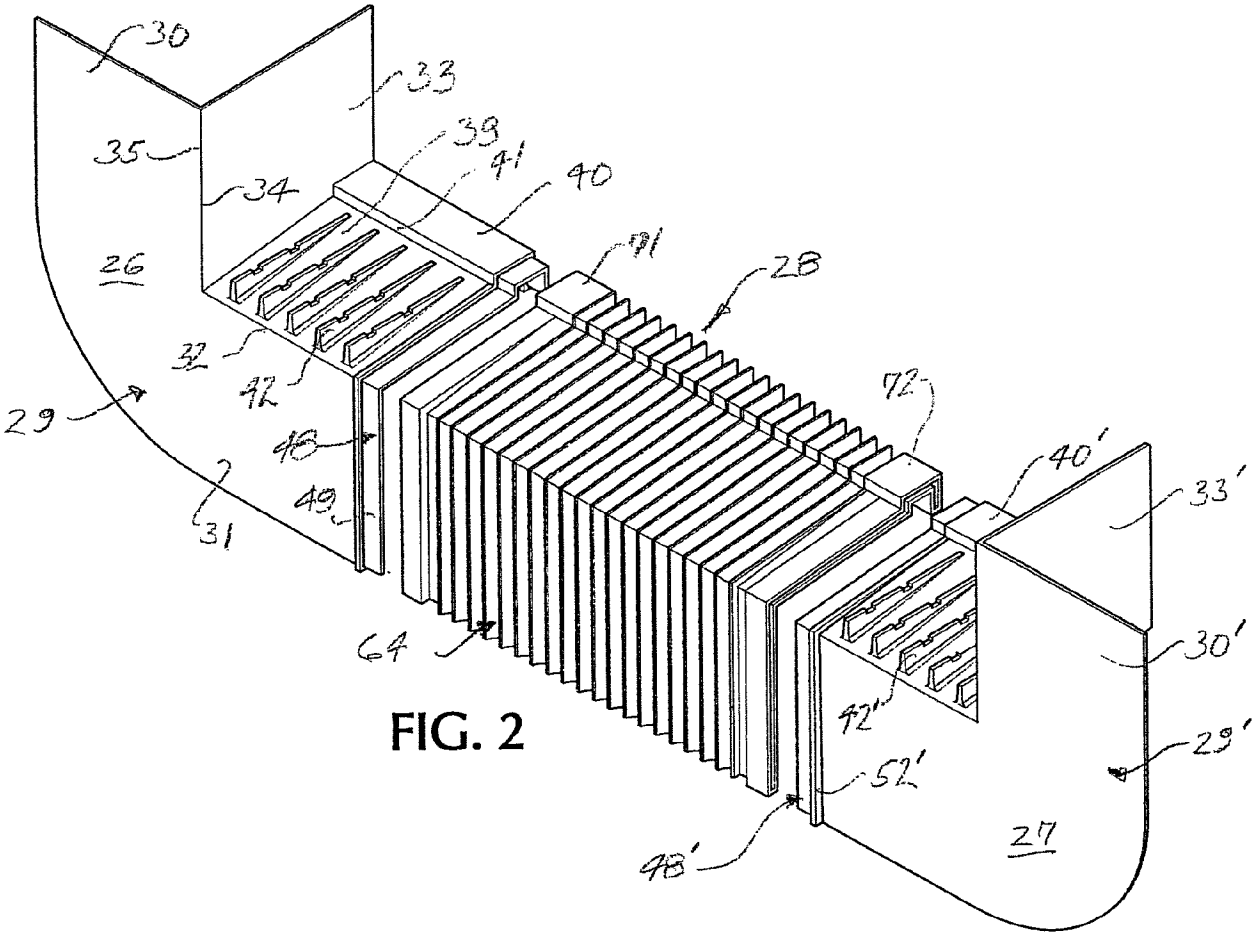
FIG. 2 is an exploded view of three components which, when joined as one, make up the one-piece sill pan flashing of FIG. 1.

A sill cover portion 36 of the end cap member is joined integrally at the front with an upper edge 32 of the front flange portion 31 and extends rearwardly and slightly upward therefrom, with its back edge 37 generally aligned with a back edge 38 of the side flange 33. The sill cover portion 36 is joined integrally with lower portions of the side flange 33 such that the entire end cap 26 forms a rigid, water-tight structure. As shown in FIG. 2, the sill cover includes an upwardly inclined panel 39, which extends rearwardly from the upper edge 32 of the front flange portion 31 at an angle of, for example, 4.3 degrees. Adjacent the back of the end cap 26, the inclined panel 39 joins integrally with a back support 40 of inverted U-shaped configuration. A forward face 41 of the support 40 extends upward from the back edge of the inclined panel 39 and serves as a positioning stop for engagement with a window unit (not shown) when inserted into the framed opening 22.

Figure 3:
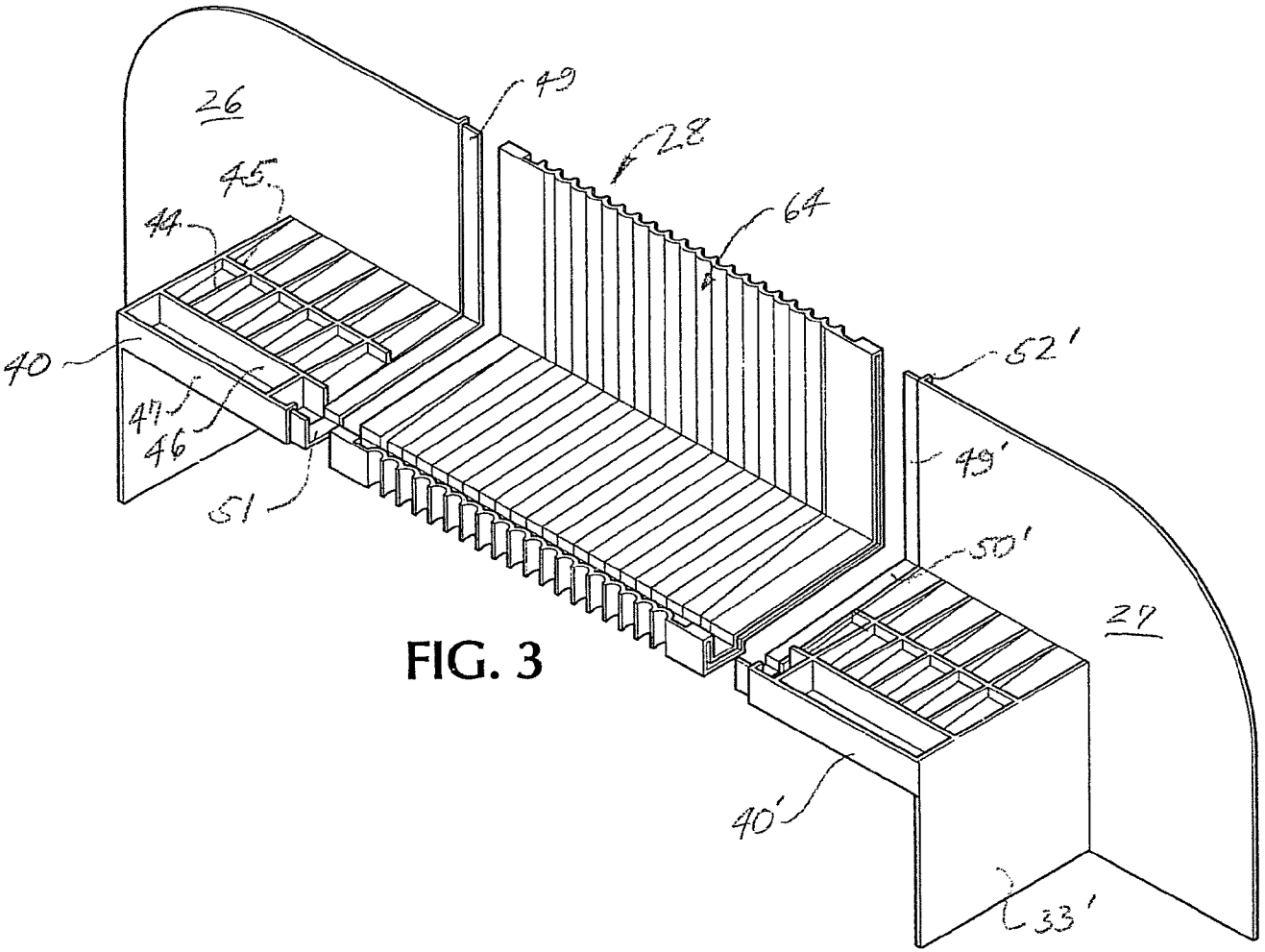
FIG. 3 is an inverted exploded view of the three components shown in FIG. 2
Figure 4:
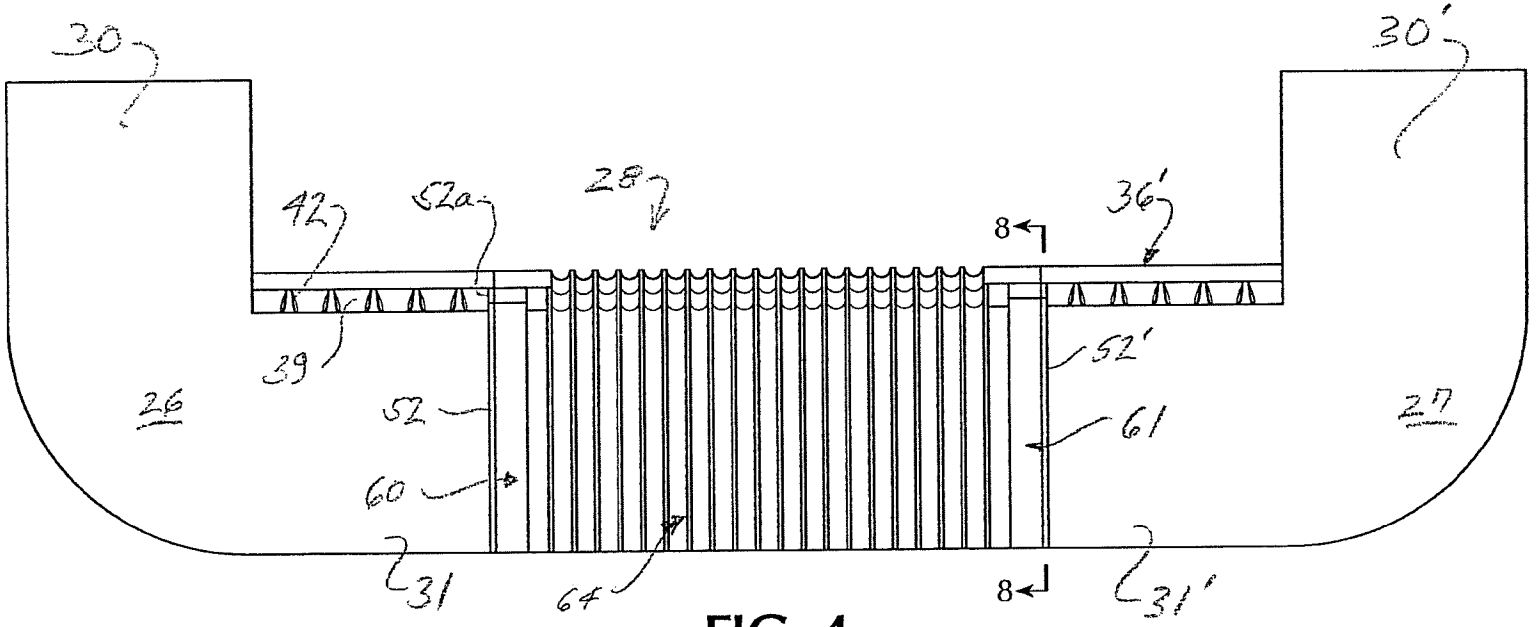
FIG. 4 is a front elevational view of the sill pan flashing of FIG. 1.
Figure 5:
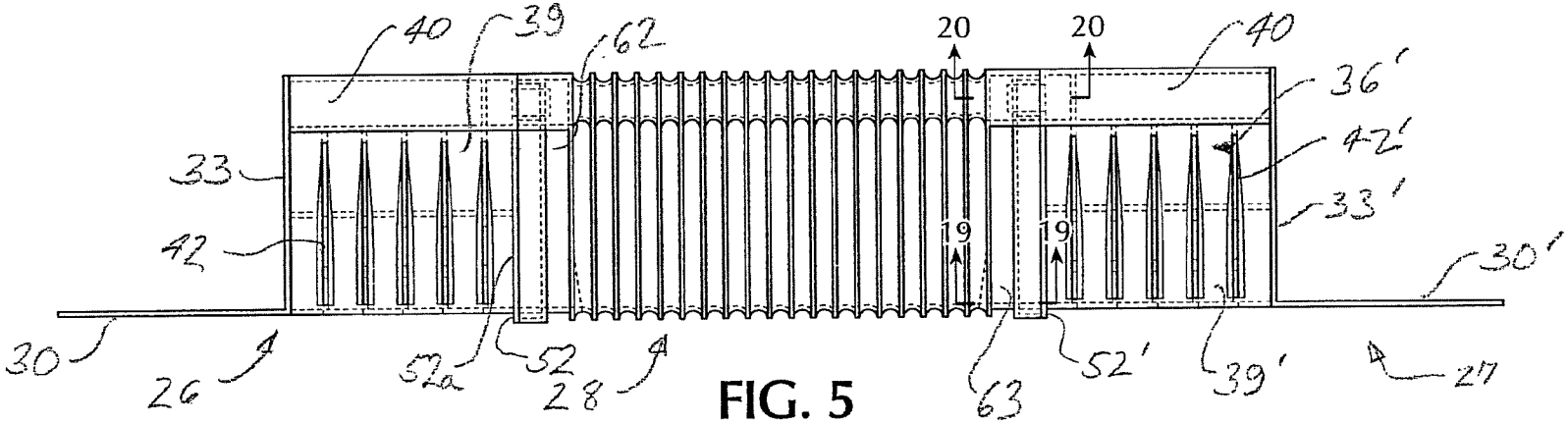
FIG. 5 is a top plan view of the sill pan flashing of FIG. 1.
Figure 6:
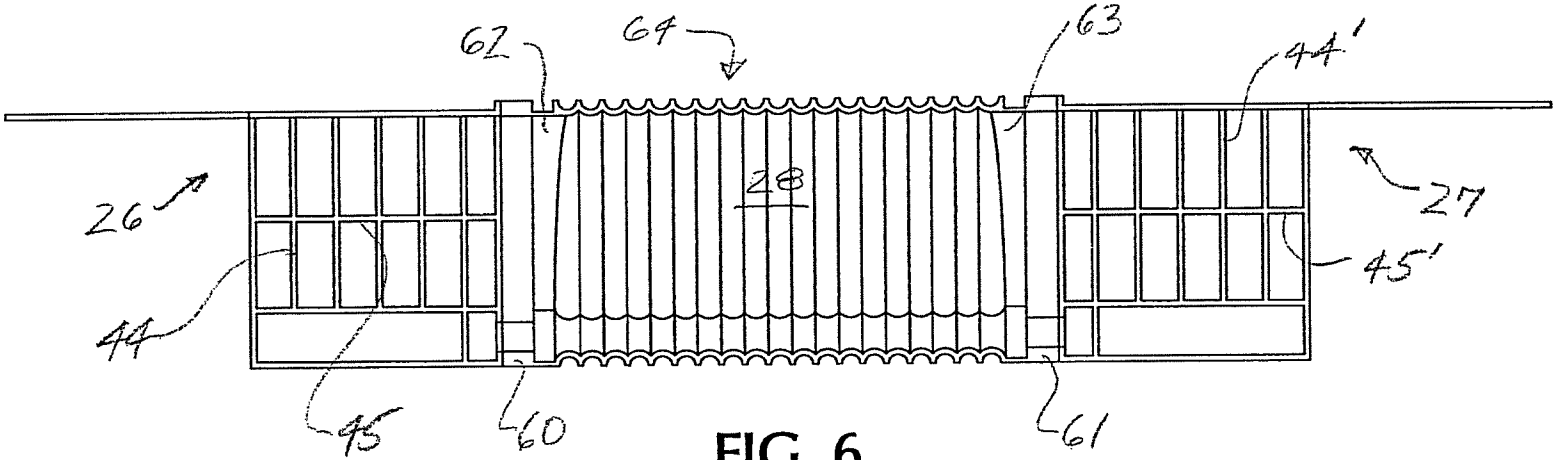
FIG. 6 is a bottom plan view of the sill pan flashing of FIG. 1.
Figure 10:
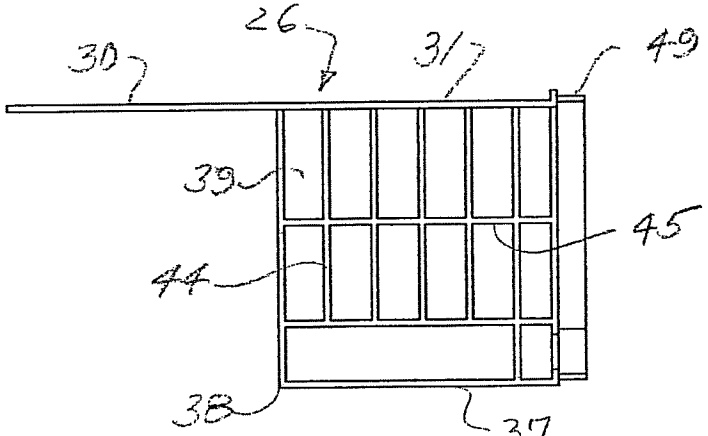
FIGS. 9, 10 and 11 are outside end elevational, bottom plan and top plan views respectively of the end cap of FIG. 7
Figure 11:
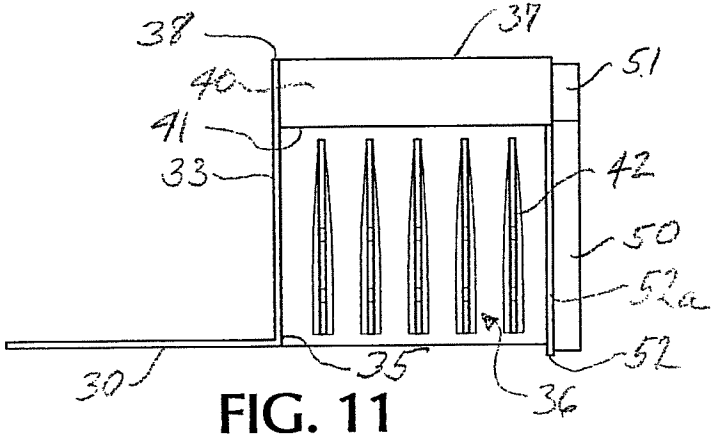
Figure 9:
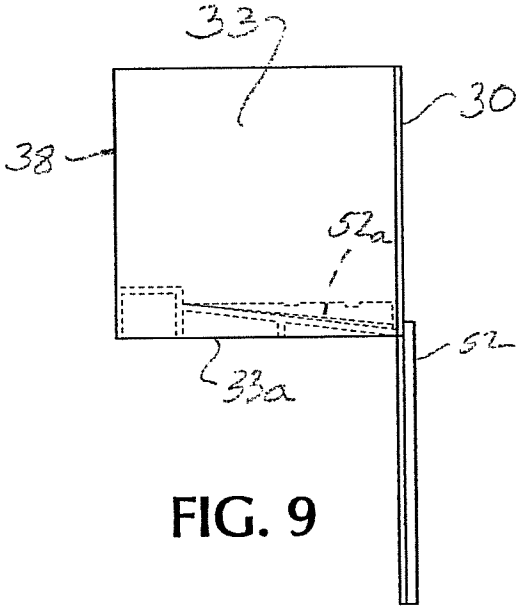

In the illustrated and preferred embodiment of the invention, the sill cover portion 36 of the end cap also serves to provide structural support for a window unit installed in the framed opening. To this end the inclined panel is formed with a plurality of laterally spaced apart support ribs 42 which extend from the front face 41 of the back support 40 to a position closely adjacent to the front flange 29. The upper surfaces 43 of the ribs lie in a common horizontal plane and are positioned to engage and support the underside of a window unit installed in the framed opening. As shown in FIGS. 3 and 10, the underside of the inclined panel 39 is formed with a plurality of triangular ribs 44 which are vertically aligned with the support ribs 42 on the opposite side of the panel 39 such that support of the window unit is transferred through the ribs 42 and 44 and onto the framing sill 23. In the illustrated end cap structure, a cross rib 45 extends at right angles to and intersects with the ribs 44 to provide additional support. Additionally, the back support 40 has front and back support flanges 46, 47 that extend downward to the framing sill 23 as shown in FIG. 3.

Although the invention is not limited to specific end cap dimensions, in a representative preferred embodiment of the invention, for a typical standard (e.g., 24") window unit, the front flange 29 may have an overall height and width of about 8 inches and may extend about 4 inches above and below the frame sill 23 and about 4 inches to either side of the inner faces of the vertical framing members 20, 21. The sill cover portions 36, 36' extend inward for about 4 inches and provide support for opposite sides of a window unit installed in the framed opening 22. For window units of relatively large width, the horizontal portions of the end caps may be extended to provide additional support for the window unit and/or support elements similar in construction to the sill cover portions 36, 36' may be incorporated into the connecting section 28 to provide support for central portions of a window unit.

As is evident in FIGS. 1 and 2, the right side end cap 27 corresponds in all respects to the left side end cap 26 except for being configured on the opposite hand, to extend inward from the right side of the framed opening. In all other aspects the design and function of the right side end cap 27 are identical in all respects to those of the left side end cap 26.

In accordance with the invention, the end caps 26, 27 are permanently joined by the connecting section 28 forming the central portion of the flashing. The connecting section 28 is shown independently in FIGS. 12-18. In the illustrated embodiment of the invention there is one connecting section 28. However, as will be understood, for horizontally elongated window units, such as for wide picture windows, there can be more than one connecting section and, where appropriate, connecting sections may be joined with one or more sections of fixed length (not shown), some of which may correspond to the sill cover portions 36 of the end caps, with ribs corresponding to the ribs 42, to provide support of an elongated window unit in one or more regions between the end caps 26, 27.

Figure 8:
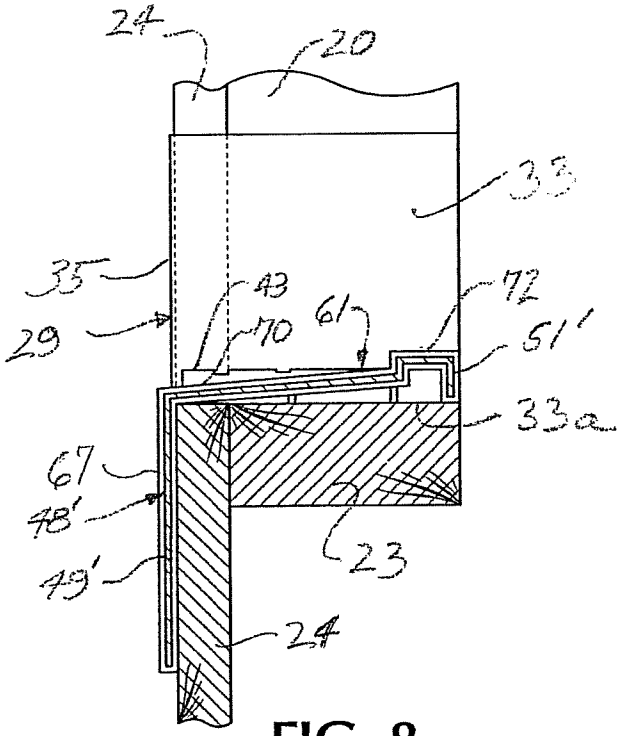
FIG. 8 is an inside end elevational view of the end cap of FIG. 7, illustrating the end cap as mounted in a rough-framed opening.
Figure 7:
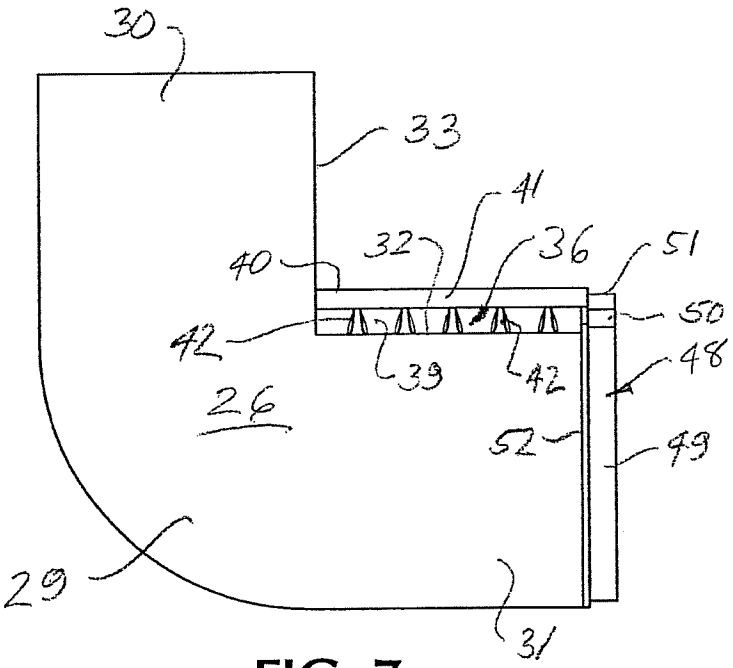
FIG. 7 is a front elevational view of an end cap forming a part of the flashing of FIG. 1.

In the illustrated form of the invention, the inwardly projecting end of the end cap 26 is formed with a connecting flange 48 comprised of a vertical front section 49 extending parallel to the front flange 29 but offset slightly forwardly thereof, such that the back surface of the front section is substantially on a plane with the front surface of the front flange 29 (see FIG. 8, in which the connecting flange 48' is shown in cross section. An inclined section 50 of the connecting flange extends rearward and slightly upward, at a somewhat lower angle than the inclined panel 39, so as to be generally at the same level as the panel 39 at the rear but offset slightly upward from the inclined panel at the front corner. At the back, the connecting flange has a generally inverted U-shaped section 51, the outer surfaces of which are offset slightly downward and inward from the corresponding surfaces of the back support 40. An abutment flange 52, 52*a* extends along the front face 29 and along the inclined panel 39 of the end cap 26 to define the inner edges of the connecting flange 48. The portion 52*a* of the abutment flange tapers from front to back as the inclined portion 50 of the connecting flange merges with the inclined panel 39 at the back portion 51.

Referring now to FIGS. 12-20, the connecting section 28 is comprised of connecting sockets 60, 61 at opposite ends, transition sections 62, 63 extending inward from the sockets, and an accordion section 64 joined at its opposite ends with the respective transition sections 62, 63. The connecting sockets are configured to closely receive the connecting flanges 48, 48' such that the end extremities of the sockets abut the flanges 52, 52' and the back supports 40, 40' as shown in FIGS. 1 and 4-6. Pursuant to the invention, the sockets 60 61 are permanently joined with the respective connecting flanges 48, 48' at the factory, by adhesives or other suitable bonding procedures, with water-tight seams, such that the resulting one-piece flashing provides a fully effective barrier to water leakage from above, with the water being diverted forwardly to the exterior of the dwelling structure. The flashings are shipped in one piece and installed without the cutting and/or assembling operations required of conventional sill pan flashing devices.

While the socket portions 60, 61 of the connecting section 28 preferably are sized to closely fit with the connecting flanges 48, 48' of the end caps, the lengths of the respective transition sections 62, 63 and of the accordion section 64 can be varied to suit the sizing and other requirements of the installation. The transition sections 62, 63 are of a fixed width and width adjustment of the device during installation is accommodated by the ability of the accordion section 64 to be extended laterally. The overall width of the connecting section 28 can be increased by enlarging the width of the transition sections 62, 63. Likewise, for some installations it may be preferable to provide more than one accordion section spaced apart and joined by one or more intermediate transition sections of fixed length.

Figure 20:
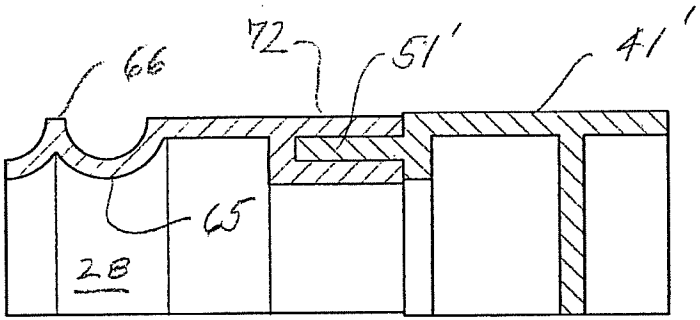
FIGS. 19 and 20 are fragmentary cross sectional views as taken generally along lines 19-19 and 20-20, respectively, of FIG. 5.
Figure 19:
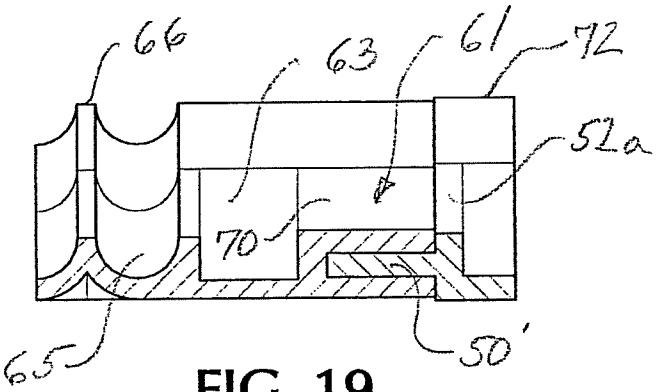

In the illustrated form of the invention, the accordion section 64 extends between the transition sections 62, 63 and is comprised of a series of connected accordion elements 65 of generally semi-cylindrical cross sectional configuration joined at their outer edges 66 (see FIGS. 19, 20). In one exemplary but non-limiting embodiment of the invention, the accordion elements may have an inside radius of about 0.155 inch and an outside radius of about 0.225 inch, with a wall thickness of about 0.070 inch. The total thickness of the accordion section 64 is less than 0.250 inch as required by many building codes. The illustrated, semi-cylindrical configuration of the accordion elements is not considered to be critical to the invention, however. Other configurations, such as connected elements forming a generally sinusoidal cross section, or elements of generally V-shaped section joined with alternate elements of inverted generally V-shaped section can be suitably employed. The principal requirements are that the configuration of the accordion elements enable a width expansion of the assembled flashing unit during installation to meet the entire range of expected width variations of the rough framing and that the accordion elements form inclined flow passages for diverting any accumulated liquid forwardly to the exterior of the structure. In any case, it is desirable to configure the according section such that its total thickness is less than 0.250 inch so that installation incorporating the flashing of the invention will satisfy code requirements.

As shown in FIG. 8, the configuration of the connecting sockets 60, 61 is such that the front portions 67, 68 thereof extend downward along the front face of the sheathing 24, while inclined portions 69, 70 are supported on the front portion of the sill opening in the sheathing. The back portions 71, 72 of the connecting sockets are configured to conform substantially with the configuration of the supports 40, 40' of the end caps, when the sockets are joined with respective end caps 26, 27.

Figure 12:
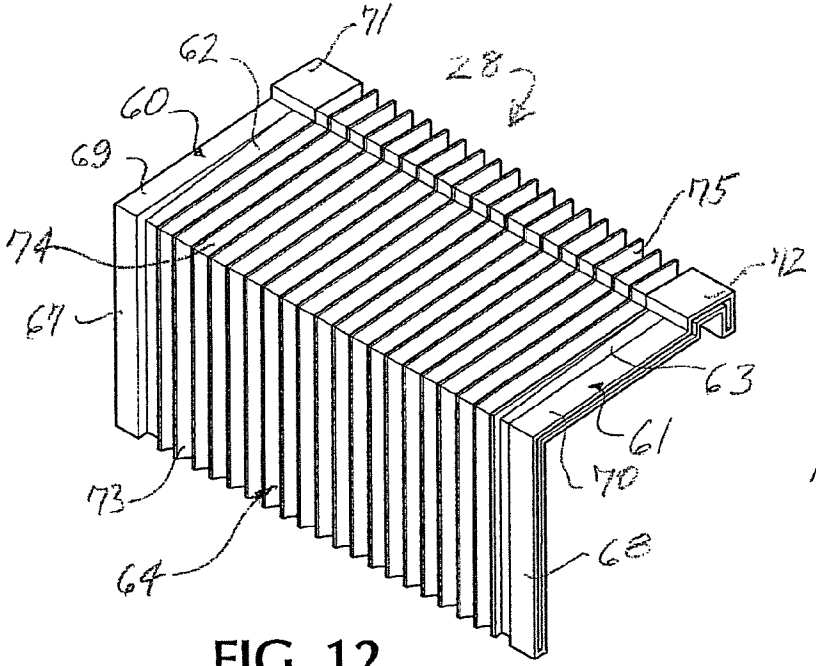
FIG. 12 is an orthographic view from above of an accordion section forming a part of the sill pan flashing of FIG. 1.
Figure 15:
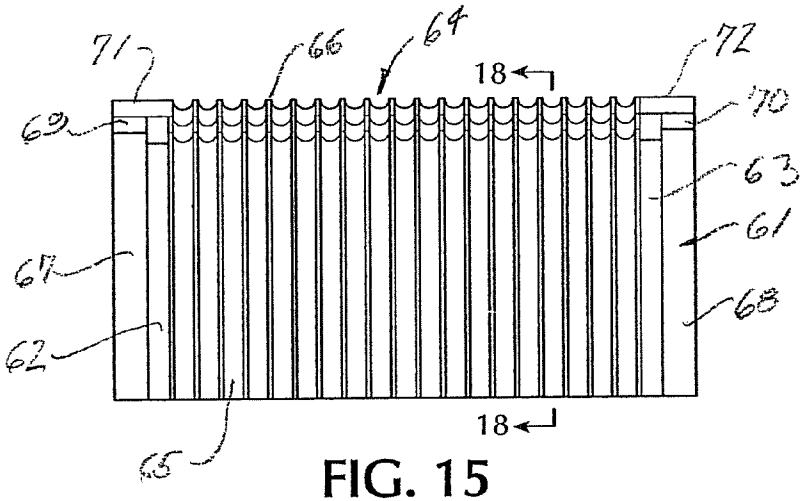
FIGS. 14-17 are top plan, front elevational, bottom plan and end elevational views, respectively, of the accordion section of FIG. 12
Figure 14:
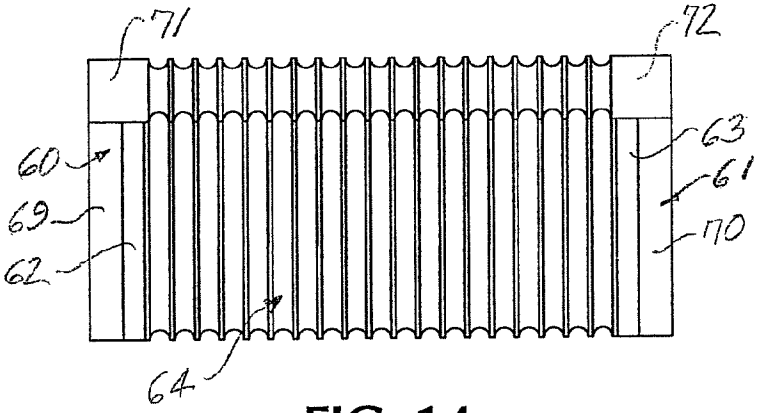
Figure 17:
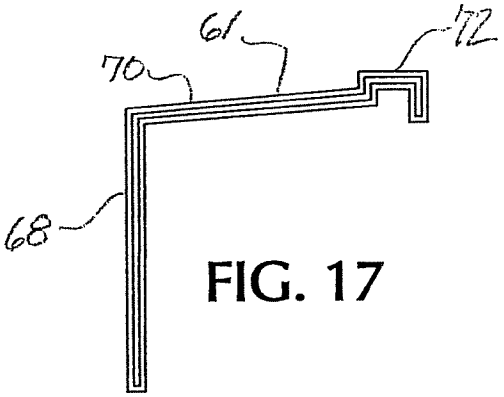
Figure 18:
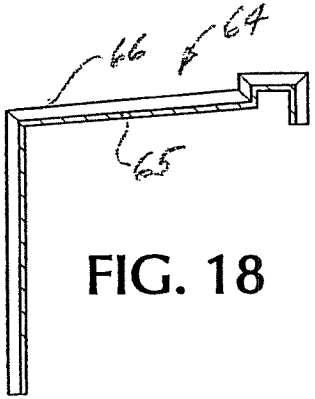
FIG. 18 is a cross sectional view as taken along line 18-18 of FIG. 15.

As can be seen in FIG. 12, the upper surfaces of the transition sections 62, 63 are substantially level with upper surfaces of the inclined portions 69, 70 of the sockets 60, 61, where the inclined portions 69, 70 join with the respective back portions 71, 72. The angle of incline of the transition sections is, however, slightly greater than that of the sockets, such that, at their forward extremities the bottom surfaces of the transition sections are substantially level with the bottom surfaces of the accordion elements 65 (see FIG. 19). Accordingly, at the front corner of the opening in the sheathing 24, the accordion elements 65 rest directly on the sheathing. Likewise, extending downward along the front of the sheathing, the inner surfaces of the accordion elements 65 lie closely against the front surface of the sheathing such that the fronts of the accordion elements lie within the 0.250 inch code requirement. In this respect, it can be noted that the new sill pan flashing is only expanded in width during installation, because of its having a designed width less than the width of the intended prefabricated window unit. Accordingly, the thickness of the accordion section is never increased in thickness during installation but can only be decreased in thickness as a result of its width expansion during installation. Theoretically, where the prefabricated window units were made to precise width dimensions, it would be possible to construct the one-piece flashings of the invention accurately to the specified width of the window because the rough framing, in which the flashing is installed could never be narrower than the actual width of the prefabricated window unit. However, realistically such precision is unlikely to be achieved and thus the one-piece flashing of the invention should have a manufactured width dimension at least slightly less than the nominal width "W" of the prefabricated window with which it is to be associated.

Figure 13:
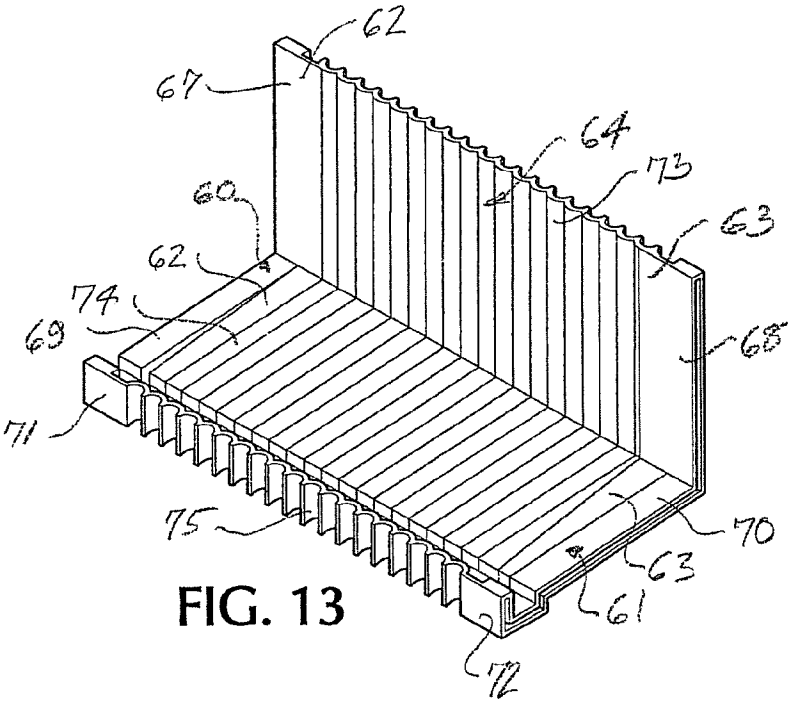
FIG. 13 is an orthographic view of the accordion section of FIG. 12, inverted to show bottom features.
Figure 16:
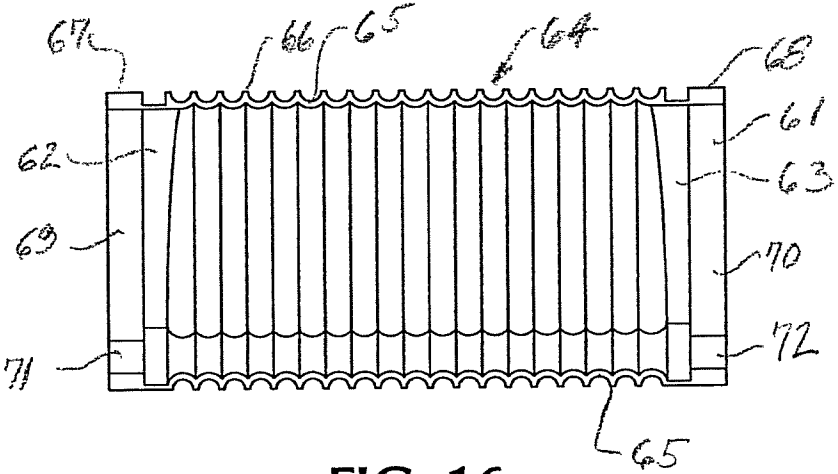

As reflected in FIGS. 12, 13 and 16, the semi-circular or other configuration of the accordion elements 65 is maintained throughout the vertically extending front portions 73, the inclined portions 74 and inverted U-shaped back portions 75. This assures that any width extensions of the accordion section 64 will be substantially uniform and will not result in unwanted distortions. The configuration of the accordion section 64 is such that, at the upper ends of the inclined portions 74 of the accordion elements 65, the upper edges 66 thereof are at a level no higher than the upper edges of the end cap support ribs 42, 42'. Likewise, the configuration of the accordion elements in the inverted U-shaped back portion 75 is such that the upper and outer element edges 66 lie within the profiles of the support portions 40, 40' of the endcaps 26, 27 to accommodate proper positioning of a window unit within the frame 22.

The illustrated accordion section 64 may be formed of a flexible plastic material, such as a flexible pvc, and advantageously is formed by thermoforming or other similar procedure. In the illustrated embodiment, the thickness of the material forming the accordion section is approximately 0.70 inch. However, neither the materials nor the method of forming nor the specific dimensions are deemed critical to the invention. All that is required is the ability of the accordion section 64 to be expanded in width during installation in a rough framed opening, preferably by a single person, without requiring special tools.

In the illustrations of FIGS. 12-16, the transition sections 62, 63 are relatively narrow as compared to the central accordion section 64. However, depending on the dimensions of the intended window, it may be desirable in some cases to use proportionately wider transition sections. The width of the accordion section 64 should always, however, be sufficient to accommodate any necessary width expansion of the flashing without unduly stressing the material of the accordion section, avoiding the formation of stress cracks or the like that over time might result in water leakage.

The construction of the invention is designed to allow a one-piece flashing to be extended from a normal, fully relaxed width configuration to a much larger width of for example 1½ to 2 inches greater than its relaxed width. This allows the sill pan flashings to be manufactured to various "standard" widths suitable, in a relaxed condition and without requiring lateral compression, to fit a rough opening of the minimum width dimension capable of receiving a standard width prefabricated window unit, while at the same time being easily expandable in width to cover a framing sill of the largest acceptable width dimension for the prefabricated window unit. In the specific, non-limiting embodiment illustrated herein, a 9 inch connecting section 28 is comprised of 19 interconnected U-shaped accordion elements 65. The overall width of the connecting section may be extended as necessary by enlarging the width of the transition sections 62, 63 and/or by providing additional accordion elements 52. For very wide frame openings, a plurality of connecting sections 48 may be joined and/or additional or wider transition sections may be utilized.

It is not expected that the accordion section 64 or sections will serve in a load-bearing capacity. For window units of smaller sizes, the entire load of the window unit can be borne by the two sill cover portions 36, 36' of the end caps 26, 27. For windows of greater width, such as picture windows, for example, additional sill cover portions (not shown) similar to the sill cover portions 36, 36' (i.e., provided with support ribs so receive the local window load) can be interposed between spaced apart connecting sections 28 or between accordion elements 65 of one or more connecting sections. Regardless of the overall width of the sill flashing unit, all of its components will be bonded together as a one-piece, width-expandable unit at the factory, and shipped and installed in the window frame as a one-piece unit.

It should be understood, or course, that the specific embodiments of the invention herein illustrated and described are intended only to be representative of the invention and not in limitation thereof. Accordingly, reference should be made to the following appended claims in determining the full scope of the invention.

What is claimed is:

1. A prefabricated, one-piece, laterally extendable sill pan flashing installable in one piece in a framed opening, where the framed opening includes opposite side members and a sill member extending between the side members, which comprises, opposite side end caps having side flanges configured to be seated against opposite side members of the framed opening and sill cover portions overlying opposite end portions of said sill member, said sill cover portions including inclined panels angled upwardly from front to back such that back portions thereof are spaced a distance above said sill member, a connecting member extending between and permanently connected to said end caps, said connecting member including at least one width-extendable accordion section, said accordion section being comprised of a series of accordion elements of a cross sectional configuration to accommodate width expansion and disposed at an incline corresponding to that of said inclined panels, with back portions of said accordion elements spaced upwardly from said sill member, to form a plurality of inclined flow passages for diverting liquid forwardly to the exterior of the structure, said accordion section being extendable in width during installation to enable the respective side flanges to be seated against the opposite side members of the framed opening.

2. A one-piece extendable sill pan flashing according to claim 1, wherein forwardly facing members extend upward from back portions of said inclined panels at an angle thereto, and the cross sectional configuration of said accordion elements is continued in upwardly extending back portions thereof disposed at an angle corresponding to, and positioned in general alignment with, said forwardly facing members.

3. A one-piece extendable sill pan flashing according to claim 1, wherein said inclined panels join at back portions thereof with supports of inverted U-shaped configuration, with portions of said supports extending downward to engage said sill member, the configuration of back portions of said accordion section generally follows that of said inverted U-shaped supports, and the cross sectional configuration of said accordion elements is continued in the back portions of said accordion section.

4. A prefabricated one-piece, laterally extendable sill pan flashing installable in one piece in a framed opening, where the framed opening includes opposite side members and a sill member extending between the side members, which comprises, opposite side end caps having side flanges configured to be seated against opposite side members of the framed opening, and a connecting member extending between and permanently connected to said end caps, said connecting member including at least one width-extendable accordion section, said accordion section being extendable in width during installation to enable the respective side flanges to be seated against the opposite side members of the framed opening, selected portions of said sill pan flashing being formed with spaced apart ribs extending upwardly and in a front to back direction for engagement with and support of a window unit installed in the framed opening, said selected portions of said sill pan flashing comprising said sill cover portions of said end caps, said end caps being formed of a rigid plastic material and including vertically oriented and outwardly facing front flanges of generally L-shaped configuration and upwardly extending side flanges joined at front edges thereof with inside edge portions of said front flanges, and said selected portions formed with said ribs being joined at outer side edges thereof with lower edges of said side flanges and at front edges thereof with upper edges of laterally extending portions of said front flanges.

5. A prefabricated one-piece extendable sill pan flashing according to claim 4, wherein said end caps are molded of a rigid plastic material, said selected portions comprise sill cover portions of said end caps configured to overlie the bottom framing member and from which said ribs extend upwardly, and second ribs extend downwardly from said sill cover and are configured for contact with the bottom framing member.

6. A prefabricated one-piece extendable sill pan flashing according to claim 5, wherein said accordion section is formed of a flexible vinyl material.

7. A prefabricated one-piece, laterally extendable sill pan flashing, installable in one piece in a framed opening having bottom and opposite side frame members defining a frame to receive a prefabricated window unit of nominal width "W", which comprises first and second end caps each formed of plastic material and comprising a vertically oriented front flange of generally L-shaped configuration including laterally extending and upwardly extending portions, an upwardly extending side flange joined at a front edge thereof with an inside edge of said upwardly extending front flange portion, and a forwardly and downwardly inclined sill cover panel joined at a forward edge thereof with an upper edge of said laterally extending flange portion and at a laterally outer edge thereof with said upwardly extending side flange, rearward portions of said sill cover panels being supported in elevated relation to said bottom frame member, a connecting section positioned between and joining said first and second end caps and comprising a forwardly and downwardly inclined sill cover portion and a downwardly extending front cover portion joined at an upper edge thereof with a front edge of said inclined sill cover portion, the sill cover portion and front cover portion of said connecting section being permanently bonded at opposite side edge portions thereof to inside side edge portions of said sill cover panels and said laterally extending flange portions of the respective end caps, at least a portion of said connecting section comprising a width-extendable accordion section accommodating a limited elongation of said connecting section, said accordion section being supported by said sill cover panels such that rearward portions of said accordion section are elevated above said bottom frame member, and elements of said accordion section form forwardly inclined flow passages above said bottom frame member and vertical flow passages in said front cover section said sill pan flashing being constructed to have an initial width dimension, measured between outer surfaces of said upwardly extending side flanges, which is less than said nominal width "W", such that the accordion section of said connecting section can be elongated and under tension when said end caps are seated against opposite side members of said framed opening.

8. A prefabricated one-piece extendable sill pan flashing according to claim 7, wherein the sill cover panels of said end caps include upper and lower integral ribs on top and bottom surfaces respectively thereof, and said lower ribs are configured to support said sill cover panels at said forwardly and downwardly inclined angle with respect to a bottom frame member and said upper ribs are configured to support a lower member of a window unit installed in said framed opening.

9. A prefabricated one-piece extendable sill pan flashing according to claim 8, wherein said upper ribs are oriented in a front to back direction and at least certain of said lower ribs are oriented in a side to side direction.

10. A prefabricated one-piece extendable sill pan flashing according to claim 8, wherein said upper ribs are configured to form a support level at or above levels of portions of said accordion section aligned laterally with said upper ribs.

11. A prefabricated one-piece extendable sill pan flashing according to claim 7, wherein said accordion section is configured to accommodate elongation in the width direction of at least about one inch.

12. The method of installing a sill pan flashing in a rough opening of a shape and size to receive a prefabricated window unit, where the rough opening includes a horizontal bottom framing member and first and second spaced apart vertical framing members, which comprises providing a one-piece, prefabricated sill pan flashing having end caps at opposite sides thereof, sill cover portions configured to overlie portions of the bottom framing member at each side thereof and disposed at an upwardly inclined angle from front to back, and a connecting section extending horizontally between and permanently connected to said sill cover portions, disposed at said inclined angle and configured to overlie the bottom framing member in vertically spaced relation thereto, at least at back portions of said connecting section, said connecting section further having an accordion portion to accommodate lateral extension of said connecting section, said accordion portion being supported at said inclined angle to overlie said bottom framing member in vertically spaced relation thereto, said accordion portion comprising a plurality of accordion elements defining forwardly and downwardly inclined flow passages, the end caps further having vertically oriented portions, configured to be engageable with the vertical framing members, and having horizontally oriented portions configured to overlie portions of the bottom framing member at each side thereof, selecting the one-piece sill pan flashing to have an initial width less than a horizontal spacing between the vertical framing members and supporting said flashing on said bottom framing member, securing one of said end caps to a vertical framing member at one side of said rough opening, expanding the width of said sill pan flashing by lateral extension of said accordion portion until the other of said end caps is in close-fitting relation to the vertical framing members, and thereafter securing said other of said end caps in said close-fitting relation to the second of said vertical framing members.

13. The method of claim 12, wherein said one-piece sill pan flashing is provided in an initial width which is at least one-half inch less than the horizontal spacing between the vertical framing members, and said one-piece sill pan flashing provided with said accordion portion is configured to accommodate elongation in the width direction of at least one inch.

* * * * *